United States Patent [19]

Oberdorf

[11] Patent Number: 4,685,554

[45] Date of Patent: Aug. 11, 1987

[54] EJECTION METHOD AND APPARATUS

[75] Inventor: Manfred Oberdorf, Gevelsberg, Fed. Rep. of Germany

[73] Assignee: Maschinerfabrik Alfred Schmermund GmbH & Co., Gevelsberg, Fed. Rep. of Germany

[21] Appl. No.: 808,341

[22] Filed: Dec. 12, 1985

Related U.S. Application Data

[63] Continuation-in-part of Ser. No. 635,645, Jul. 30, 1984, abandoned.

[30] Foreign Application Priority Data

Aug. 5, 1983 [DE] Fed. Rep. of Germany ..... 3328323

[51] Int. Cl.[4] ..... B65G 47/34

[52] U.S. Cl. ..... 198/468.6; 198/483.1

[58] Field of Search ..... 198/483.1, 468.6, 419, 198/479.1, 477.1; 53/575, 148; 493/472

[56] References Cited

U.S. PATENT DOCUMENTS

| | | | |
|---|---|---|---|
| 2,834,500 | 5/1958 | Jackson | 198/343 |
| 4,367,618 | 1/1983 | Focke | 198/468.6 |
| 4,476,665 | 10/1984 | Oberdorf | 53/575 |

FOREIGN PATENT DOCUMENTS

| | | |
|---|---|---|
| 2204268 | 8/1973 | Fed. Rep. of Germany . |
| 2259193 | 6/1974 | Fed. Rep. of Germany . |
| 2367108 | 6/1975 | Fed. Rep. of Germany . |
| 728071 | 6/1932 | France . |
| 2036680 | 7/1980 | United Kingdom . |

*Primary Examiner*—Joseph E. Valenza
*Assistant Examiner*—D. Glenn Dayoan
*Attorney, Agent, or Firm*—Chilton, Alix & Van Kirk

[57] ABSTRACT

Partially completed cigarette packages are ejected from cells mounted on a turret of a wrapping machine by a pusher device which is caused to both reciprocate axially with respect to the cells and also to move with the cells over a limited arcuate range. The reciprocating motion is controlled so that the impact speed of the pusher device on the cigarettes is low while the average pusher device speed is relatively high. The arcuate motion of the pusher device is controlled so that the time required to complete the ejection and withdrawal strokes thereof can be greater than the dwell time between steps of motion of the cells. A back-up member moves in synchronism with the pusher device during the ejection stroke to prevent opening of the package end opposite to that corresponding to the operating region of the pusher device.

16 Claims, 3 Drawing Figures

EJECTION METHOD AND APPARATUS

CROSS-REFERENCE TO RELATED APPLICATION

This application is a continuation-in-part of application Ser. No. 635,645 filed July 30, 1984, now abandoned.

BACKGROUND OF THE INVENTION (1) Field of the Invention

The present invention relates to the removal of articles, and particularly partially packaged articles which are relatively fragile, from mandrels or cells of a package forming machine. More specifically, this invention is directed to pusher-type apparatus for imparting motion to cigarettes and especially to partially wrapped cigarette blocks which are susceptible to impact damage. Accordingly, the general objects of the present invention are to provide novel and improved methods and apparatus of such character.

(2) Description of the Prior Art

The present invention is intended for use in the packaging of cigarettes. Cigarette package forming machines typically include hollow cells or mandrels which receive preformed "blocks" of cigarettes. A paper wrapping is formed around the mandrel and folded over the bottom thereof, the wrapping being held in the closed condition after folding by means of an adhesive. In order to subsequently close the other or "head" side of the package, the cigarette blocks together with the wrapping are transferred to a head-closing mechanism, for example a head-closing turret, by means of a push-rod type ejector. In order to provide the packaging material which will be folded to form the closed head end of the package, the wrapping will extend beyond the cigarettes, i.e., at the time of transfer to the head-closing mechanism the cigarettes are set back relative to the open end of the wrapping.

An example of a prior art packaging machine with a push-rod type ejector may be seen from U.S. Pat. No. 4,476,665. In the apparatus disclosed in U.S. Pat. No. 4,476,665, each cell of a wrapping turret is provided with a ram, the "rest" position of these rams being defined and maintained by a circular guide ring. The guide ring is interrupted at the position where the partially wrapped cigarette block is to be ejected from a cell so that a reciprocal actuator may engage the ring, against which the ends of the cigarettes are already resting, and eject the partially formed package from the cell. Thus, in the apparatus of U.S. Pat. No. 4,476,665 the ram limits the receiving region of the cell. While this arrangement permits, in the case of the packaging of filter cigarettes, the filter ends to be pushed into contact with the ram when the cigarette block is loaded into the cell, it also requires that the tobacco ends be contacted in order to load the block into the cell. This contact with the tobacco ends, and the axial loading which subsequently occurs when the filter ends contact the ram during insertion, presents the possibility of damage to the cigarettes.

It is also known, for example see published German Patent application No. 2,363,108, to employ slotted cells in order to minimize the standstill time of the turret of the packaging machine. The use of a slotted cell permits the ejector device to be moved out of the transfer plane subsequent to conclusion of the pushing action. Such slotted cells, however, have the disadvantages that there is a danger the package will open before the adhesive has set and that the mechanism required to pivot the e3ector device out of the transfer plane is relatively complex and thus expensive.

SUMMARY OF THE INVENTION

The present invention overcomes the above-briefly discussed and other deficiencies and disadvantages of the prior art by providing a novel and improved technique for ejecting cigarettes, particularly partially wrapped cigarette blocks, from the hollow cells of a packaging machine. The present invention also encompasses a novel apparatus for use in the practice of such improved method. The method and apparatus of the invention are particularly well-suited for use in the transfer of relatively fragile bar-shaped articles. Apparatus in accordance with the invention is characterized by relatively modest cost.

In accordance with a preferred embodiment, the apparatus of the invention includes a push-rod or ram which is mounted so as to be axially movable, between two end positions, relative to the cells of a wrapping machine turret. The direction of motion of the push-rod is controlled by a guide mechanism and is produced by a cam drive in such a manner that, after being initially accelerated, the push-rod will be braked to a lower feed speed immediately prior to coming into contact with the cigarettes and, subsequently, the push-rod will be again accelerated to complete the ejection cycle. The guide mechanism for the push-rod is itself mounted for rotation about the axis of the turret and is also driven by a cam mechanism in such a manner as to cause the guide mechanism, and thus the push-rod, to move in synchronism with the turret over a limited range of motion. This permits the time it takes to accomplish the ejection of the articles from the turret cell to exceed the standstill time of the turret, the turret being moved in stepwise fashion.

In the case of a cigarette packaging system, the present invention permits the cigarettes to be contacted at their filter ends both when they are pushed into the cells of the wrapping turret and when the partially completed package is pushed out of the cells. Also, during the ejection step, the push-rod does not impact on the cigarettes during the time it is traveling at its maximum speed and thus the possibility of damage to the cigarettes is minimized.

In a preferred embodiment of a cigarette packaging system in accordance with the present invention, means are provided for preventing the freshly-glued bottom of the package from opening during ejection. Thus, a back-up member or "fetching" rod which closely approaches or contacts the closed and glued end of the wrapping may be provided. Such a "fetching" rod is caused to move in synchronism with the push-rod during the ejection stroke.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which.

DESCRIPTION OF THE DISCLOSED EMBODIMENT

Figure 1:
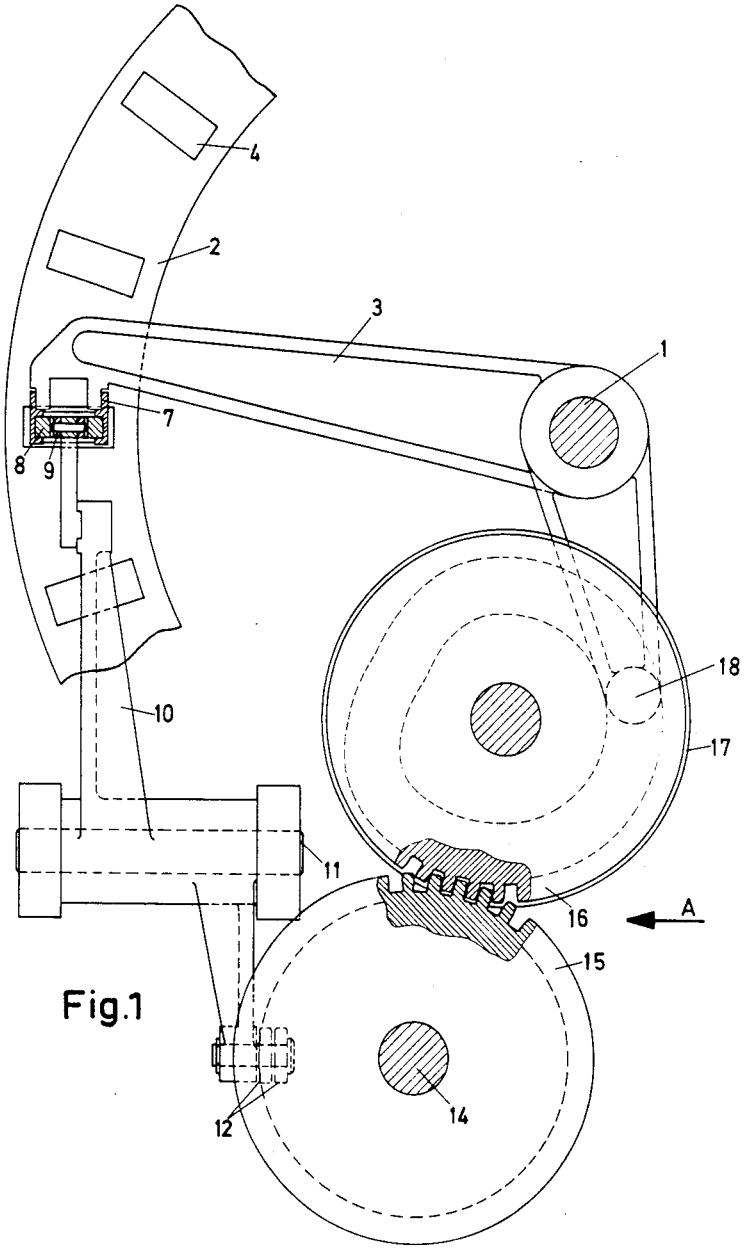
FIG. 1 is a side elevation view, partly in section, of apparatus in accordance with a preferred embodiment of the present invention.
Figure 2:
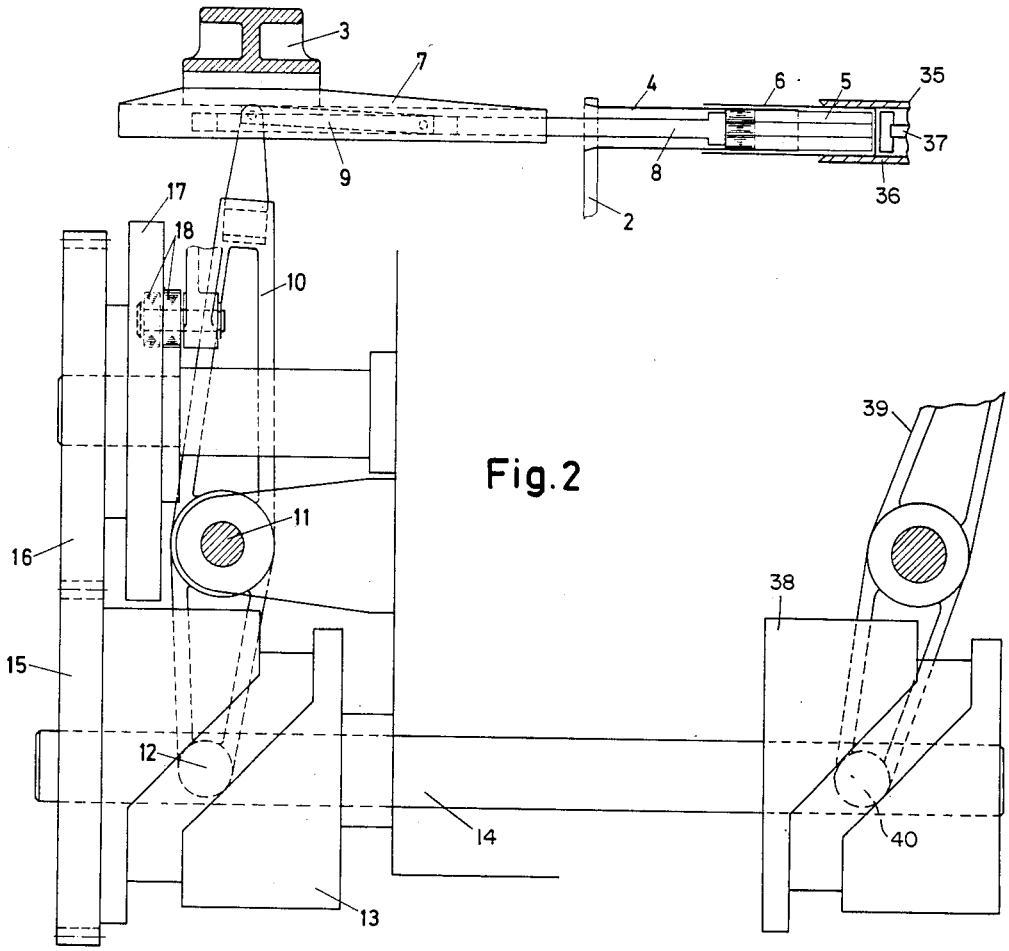
FIG. 2 is a side elevation view, partly in section, of the apparatus of FIG. 1 viewed in the direction of arrow A.

Referring jointly to FIGS. 1 and 2, a bottom-folding type packaging machine is partially shown. The packaging machine includes a first turret 2 which is rotatable about an axle 1. The turret 2 supports tubular cells 4 which receive cigarettes 5 which have been formed into "blocks". After each the cells has been loaded with cigarettes, a wrapping 6 is folded thereabout and then closed at first or bottom end as indicated in FIG. 2 at 36.

A lever 3 extends from axle 1 and is rotatable with respect thereto. A guide 7 for a push-rod 8 is fastened to lever 3. Push-rod 8 is connected to a second lever 10 via an articulated connecting rod 9 which passes through the guide 7. Lever 10 is pivotally mounted on an axle 11. Motion is imparted to lever 10 via rollers 12 which engage the track of an axial-groove cam 13. Cam 13 is affixed to a drive shaft 14. A gear 15 is also fixed to shaft 14 for rotation therewith. Gear 15 engages a gear 16 which has affixed thereto a rotatable cam 17, cam 17 also being of the axial-groove type. Motion is imparted to lever 3 by means of cam-follower rollers 18 which travel in the axial groove of cam 17 as may best be seen from FIG. 1.

In the manner to be described below, the push-rod 8 transports the wrapping 6 which contains the cigarette block, the wrapping having been glued and closed at the bottom end but not yet closed at the top end, into a cell 35 of a further turret which forms part of the wrapper top-closing mechanism. In order to insure that the freshly-glued bottom 36 of the wrapping 6 does not reopen under the action of push-rod 8, the bottom is contacted or closely approached by a "fetching" rod 37. A further axial-groove cam 38 is mounted on drive shaft 14. The "fetching" or back-up rod 37 is actuated, via a lever 39, by cam followers 40 which travel in the groove of cam 38. The cam followers 40 are mounted on the first end of lever 39. The "fetching" rod 37 is connected to the end of lever 39 disposed oppositely with respect to cam followers 40.

The turret 2 is rotated in steps in the known manner via an indexing cam, not shown.

Referring again to FIG. 2, the cigarettes 5 will be set back relative to the open end of the wrapping 6 at the time it is desired to eject the partially completed package from the cells 4, the excess length of the wrapping being used to close the open end of the package. Accordingly, the push-rod 8 must travel the set-back distance before it contacts the cigarettes 5. In order to minimize the possibility of damage to the cigarettes, the push-rod 8 should be traveling at a relatively low speed when it contacts the cigarettes. However, for the reason which will be explained in greater detail below, the average speed of the push-rod 8 mut be considerably greater than the contact speed in order for the packaging machinery to have an acceptable production rate. Accordingly, the push-rod 8 will first be accelerated, its speed will then be retarded as it approaches the cigarettes, and the push-rod will then be again accelerated after contact with the cigarettes has been established.

Figure 3:
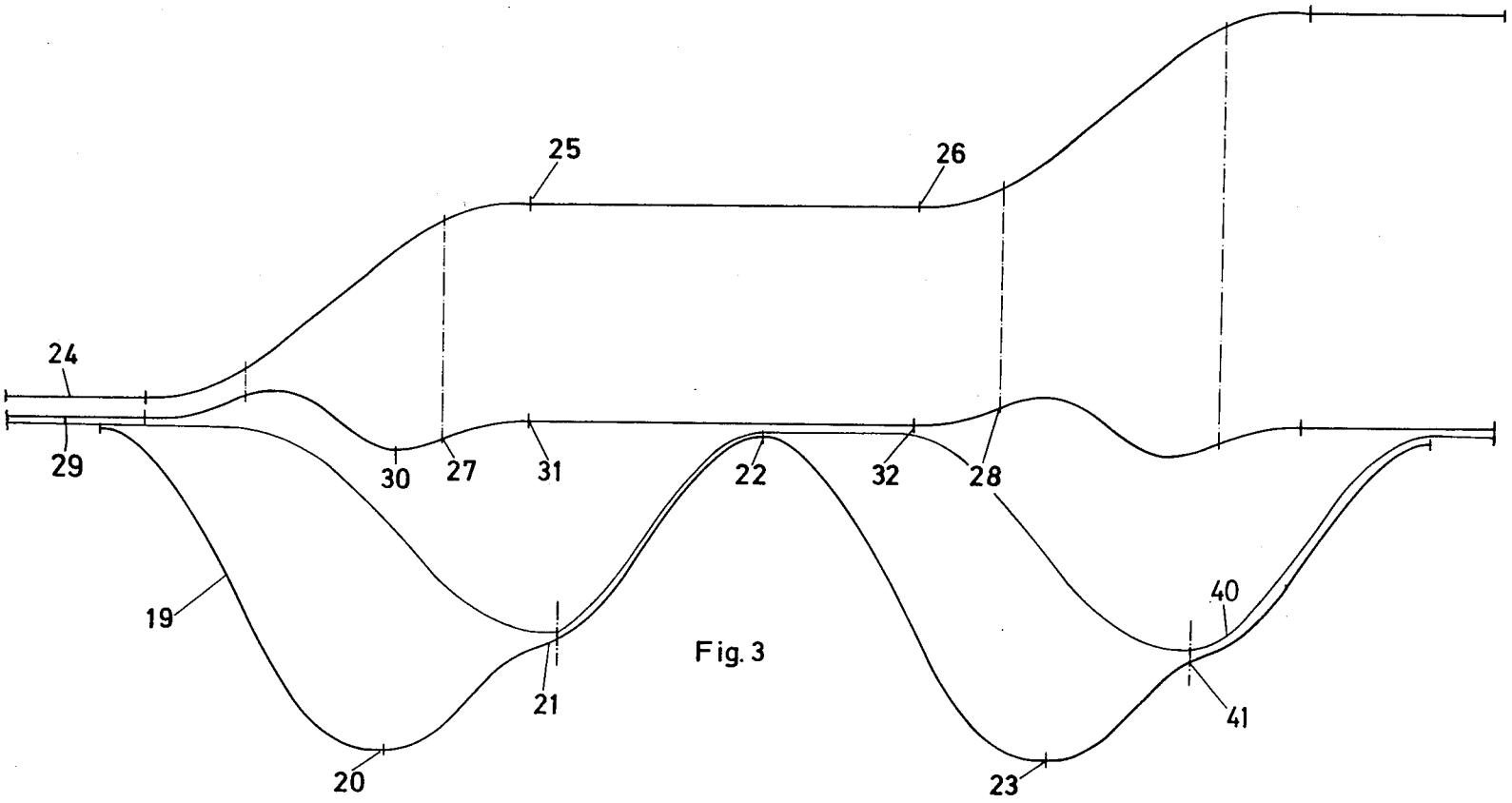
FIG. 3 graphically depicts the motion of the push-rod, push-rod guide, "fetching" rod and packaging machine turret of the apparatus shown in FIGS. 1 and 2.

The cycle of movement of the push-rod 8 is depicted by curve 19 of FIG. 3. The forward movement of push-rod 8 starts at point 20. The push-rod is first accelerated and then is decelerated until it contacts the cigarettes 5 at point 21. Subsequently, the ejection action is accelerated and is completed at point 22. The push-rod 8 then returns to its initial position which is represented by point 23. This cycle of movement of the push-rod 8 requires a certain amount of time because, in order to avoid treating the cigarettes 5 too roughly, a predetermined maximum acceleration should not be exceeded. In fact, because of the slowing down of the push-rod 8 which occurs in the region of point 21, the ejection cycle will be longer than the acceptable standstill time of turret 2. The movement of turret 2 is represented by curve 24 of FIG. 3 with the standstill or dwell time between steps being represented by the curve portion between points 25 and 26.

In order to accomodate the added time required for the ejection action, the guide 7 is moved in the manner represented by curve 29 on FIG. 3, this movement being parallel to and synchronized with that of a cell 4 on turret 2 in the range between points 27 and 28. The guide 7 is first accelerated from point 30 until it comes into synchronism with the turret at point 27. The distance between point 20 and point 27 is determined by the distance between the push-rod 8 in its initial position and turret 2. From point 31 to point 32 both guide 7 and turret 2 are at rest. Both are then accelerated again and, at point 28, synchronism is ended since at this point the push-rod 8 has been withdrawn from the cell 4. The guide 7 then returns to its initial position.

Because of the above-discussed reduction in the velocity of the push-rod 8 as it approaches point 21, i.e., the end of the cigarette block, it is possible to maintain the "fetching" rod 37 in close proximity to the bottom 36 of the wrapping 6 thus preventing the reopening thereof. The motion of the "fetching" rod 37 is represented by curve 40 on FIG. 3. FIG. 3 shows that, as a consequence of the configuration of cam 38, the movement of the "fetching" rod 37 is synchronized with that of the push-rod 8 from the contact point 21 (41) to the end of the ejection stroke. Thus, the reduction of the push-rod velocity not only protects the cigarettes from impact damage, but also permits the use of a "fetching" or back-up rod which will insure that the freshly-glued end of the cigarette package will not reopen as a result of forces generated by the push-rod during the ejection stroke.

The cam followers of the disclosed embodiment of the present invention comprise pairs of rollers 12, 18 and 40 in order to achieve a precise positive drive. These rollers travel in respective double roller radial-groove cams 13, 17 and 38, one roller of each pair running on the outer surface of the cam and the other roller of each pair running on the inner surface of the cam.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. Apparatus for transferring partially package cigarette blocks from a rotatable first carrier provided with first cells into second cells of a second carrier for completing the packing, said first carrier having a revolution axis and said first cells being provided for receiving a block of cigarettes therein, the cells having axes and the carriers moving cells into an aligned transfer position, periodically in stepwise fashion, the steps of movement of the carriers being commensurate with the spacing between the axes of adjacent cells, a cell in the transfer position being circumscribed by a wrapper which is folded over a first end of the cell containing a cigarette block to form a first closed package end, the second opposite end of the package being open, said transferring apparatus comprising:

push-rod means, said push-rod means having an axis and being axially movable with respect to the carrier cells in the transfer position between first and second limits of motion;

movable guide means for said push-rod means, said guide means being rotatably mounted on said revolution axis of said first carrier and further engaging said push-rod means and determining the position of the axis thereof relative to the carrier axes;

first means for imparting variable speed reciprocal motion to said push-rod means, said first motion imparting means cooperating with said guide means and including first cam means having a profile which results in said push-rod means being initially accelerated and thereafter braked to a lower feed speed at the time said push-rod means contacts the cigarette block within a first cell in the transfer position which cigarette block is to be transferred together with the wrapper folded over said first cell from said first cell into an adjacent second cell, said first motion imparting means subsequently accelerating said push-rod means to complete the transfer of the block and the wrapper;

cam drive means for said guide means, said cam drive means synchronizing the motion of said guide means with the rotational motion of a first cell on the first carrier, said cam drive means permitting the axial motion of said push-rod means to exceed the dwell time between the steps of motion on the first carrier;

back-up means for cooperating with the first closed package end to prevent the reopening thereof, said back-up means being axially movable with respect to the carrier cells between first and second limits of motion; and second means for imparting reciprocal motion to said back-up means, said second motion imparting means including second cam means and causing said back-up means to move in synchronism with said push-rod means during the time said push-rod means is in contact with the cigarettes of a block being transferred.

2. The apparatus of claim 1 wherein said drive means comprises:

third cam means having a cam and a cam follower; and first lever means, said first lever means coupling said guide means to the follower of said third cam means, said first lever means being mounted for arcuate motion about the axis about which the carrier rotates.

3. The apparatus of claim 2 wherein said first motion imparting means further comprises:

a follower coupled to said first cam means;

second lever means, a first end of said second lever means being connected to the follower of said first cam means; and connecting rod means, said connecting rod means coupling the second end of said second lever means to said push-rod means, the motion of said connecting rod means being guided by said guide means.

4. The apparatus of claim 1 wherein said first motion imparting means further comprises:

a follower coupled to said first cam means;

first lever means, a first end of said first lever means being connected to the follower of said first cam means; and connecting rod means, said connecting rod means coupling the second end of said first lever means to said push-rod means, the motion of said connecting rod means being guided by said guide means.

5. The apparatus of claim 1 further comprising:

common actuator means for said motion imparting means first and second cam means and said drive means.

6. The apparatus of claim 2 further comprising:

common actuator means for said motion imparting means first and second cam means and said drive means third cam means.

7. The apparatus of claim 3 further comprising:

common actuator means for said motion imparting means first and second cam means and said drive means third cam means.

8. The apparatus of claim 4 further comprising:

common actuator means for said motion imparting means first and second cam means and said drive means.

9. The apparatus of claim 2 wherein said cam means each comprise:

a radial-groove cam; and wherein said followers each comprise:

a pair of rollers for engaging opposite sides of an associated cam groove.

10. The apparatus of claim 7 wherein said cam means each comprise:

a radial-groove cam; and wherein said followers each comprise:

a pair of rollers for engaging opposite sides of an associated cam groove.

11. The apparatus of claim 1 wherein said second motion imparting means further comprises:

a follower coupled to said second cam means;

first pivotal lever means, a first end of said first lever means being connected to the follower of said second cam means; and means coupling the second end of said first lever means to said back-up means.

12. The apparatus of claim 2 wherein said second motion imparting means further comprises:

a follower coupled to said second cam means;

second pivotal lever means, a first end of said second lever means being connected to the follower of said second cam means; and means coupling the second end of said second lever means to said back-up means.

13. The apparatus of claim 3 wherein said second motion imparting means further comprises:

a follower coupled to said second cam means;

third pivotal lever means, a first end of said third lever means being connected to the follower of said second cam means; and means coupling the second end of said third lever means to said back-up means.

14. The apparatus of claim 13 further comprising:

common actuator means for said motion imparting means first and second cam means and said drive means third cam means.

15. The apparatus of claim 4 wherein said cam means each comprise:

a radial-groove cam; and wherein said followers each comprise:

a pair of rollers for engaging opposite sides of an associated cam groove.

16. The apparatus of claim 1 wherein said second means for imparting reciprocal motion to said back-up means produces a first limit of back-up means motion for substantially contacting said folded wrapper at the moment said first closed package end is established and thereafter moves said back-up means in a reverse direction while in contact with the first closed package end, to said second limit position permitting the cigarette block to be completely transferred to said second cell.

* * * * *